US007152609B2

(12) United States Patent
Li et al.

(10) Patent No.: US 7,152,609 B2
(45) **Date of Patent: *Dec. 26, 2006**

(54) CATALYST TO REDUCE CARBON MONOXIDE AND NITRIC OXIDE FROM THE MAINSTREAM SMOKE OF A CIGARETTE

(75) Inventors: Ping Li, Richmond, VA (US); Firooz Rasouli, Midlothian, VA (US); Mohammad Hajaligol, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 345 days.

This patent is subject to a terminal disclaimer.

(21) Appl. No.: 10/460,303

(22) Filed: Jun. 13, 2003

(65) Prior Publication Data

US 2004/0250826 A1 Dec. 16, 2004

(51) Int. Cl.
*A24B 15/18* (2006.01)

(52) U.S. Cl. ..... 131/334; 131/364; 131/360; 131/365; 131/331

(58) Field of Classification Search ..... 131/364, 131/334, 360, 365, 331
See application file for complete search history.

(56) References Cited

U.S. PATENT DOCUMENTS

| | | | |
|---|---|---|---|
| 3,292,636 | A | 12/1966 | Mays |
| 3,720,214 | A | 3/1973 | Norman et al. |
| 3,807,416 | A | 4/1974 | Hedge et al. |
| 3,931,824 | A | 1/1976 | Miano et al. |
| 4,108,151 | A | 8/1978 | Martin et al. |
| 4,109,663 | A | 8/1978 | Maeda et al. |
| 4,119,104 | A | 10/1978 | Roth |
| 4,182,348 | A | 1/1980 | Seehofer et al. |
| 4,195,645 | A | 4/1980 | Bradley, Jr. et al. |
| 4,197,861 | A | 4/1980 | Keith |
| 4,199,104 | A | 4/1980 | Houben |
| 4,256,609 | A | 3/1981 | Dale et al. |
| 4,301,035 | A | 11/1981 | Risse |
| 4,317,460 | A | 3/1982 | Dale et al. |
| 4,368,029 | A | 1/1983 | Lacroix |
| 4,450,245 | A | 5/1984 | Carlisle et al. |
| 4,450,847 | A | 5/1984 | Owens |
| 4,453,553 | A | 6/1984 | Cohn |
| 4,463,030 | A | 7/1984 | Deffeyes et al. |
| 4,489,739 | A | 12/1984 | Mattina, Jr. et al. |
| 4,524,051 | A | 6/1985 | Sampson et al. |
| 4,744,374 | A | 5/1988 | Deffeves et al. |
| 4,763,674 | A | 8/1988 | Lelah |
| 4,855,274 | A | 8/1989 | Upchurch et al. |
| 4,875,910 | A | 10/1989 | Dunnigan et al. |
| 4,940,686 | A | 7/1990 | Tooley et al. |
| 4,956,330 | A | 9/1990 | Elliott et al. |
| 4,957,710 | A | 9/1990 | Nagai et al. |
| 4,991,181 | A | 2/1991 | Upchurch et al. |
| 5,017,357 | A | 5/1991 | Kolts et al. |
| 5,040,551 | A | 8/1991 | Schlatter et al. |
| 5,050,621 | A | 9/1991 | Creighton et al. |
| 5,101,839 | A | 4/1992 | Jakob et al. |
| 5,105,836 | A | 4/1992 | Gentry et al. |
| 5,129,408 | A | 7/1992 | Jakob et al. |
| 5,211,684 | A | 5/1993 | Shannon et al. |
| 5,258,340 | A | 11/1993 | Augustine et al. |
| 5,281,447 | A | 1/1994 | Brady et al. |
| 5,284,166 | A | 2/1994 | Cartwright et al. |
| 5,292,594 | A | 3/1994 | Liburdi et al. |
| 5,322,075 | A | 6/1994 | Deevi et al. |
| 5,386,838 | A | 2/1995 | Quincy, III et al. |
| 5,388,177 | A | 2/1995 | Ono et al. |
| 5,446,003 | A | 8/1995 | Augustine et al. |
| 5,462,903 | A | 10/1995 | Rousset et al. |
| 5,494,704 | A | 2/1996 | Ackerman |
| 5,503,874 | A | 4/1996 | Ackerman et al. |
| 5,585,020 | A | 12/1996 | Becker et al. |
| 5,591,368 | A | 1/1997 | Fleishhauer et al. |
| 5,598,868 | A | 2/1997 | Jakob et al. |
| 5,620,672 | A | 4/1997 | Galligan et al. |
| 5,671,758 | A | 9/1997 | Rongved |
| 5,702,836 | A | 12/1997 | Ma et al. |
| 5,728,462 | A | 3/1998 | Arino et al. |
| 5,731,257 | A | 3/1998 | Quincy III et al. |
| 5,766,562 | A | 6/1998 | Chattha et al. |
| 5,850,047 | A | 12/1998 | Tani et al. |
| 5,865,959 | A | 2/1999 | Meinzer et al. |
| 5,934,289 | A | 8/1999 | Watkins et al. |

(Continued)

FOREIGN PATENT DOCUMENTS

| | | | |
|---|---|---|---|
| EP | 0499402 | A1 | 8/1992 |

(Continued)

OTHER PUBLICATIONS

International Search Report and Written Opinion for PCT/IB2004/002188 dated Dec. 10, 2004.

(Continued)

*Primary Examiner*—Dionne W. Mayes
(74) *Attorney, Agent, or Firm*—Buchanan Ingersoll & Rooney PC

(57) ABSTRACT

Cut filler compositions, cigarettes, methods for making cigarettes and methods for smoking cigarettes are provided, which involve the use of a catalyst capable converting carbon monoxide to carbon dioxide and/or nitric oxide to nitrogen. Cut filler compositions comprise tobacco and at least one catalyst. Cigarettes are provided, which comprise a cut filler having at least one catalyst. The catalyst comprises nanoscale metal and/or metal oxide particles supported on a fibrous support. The catalyst can be prepared by combining a dispersion of nanoscale particles with a fibrous support, or by combining a metal precursor solution with a fibrous support and then heat treating the fibrous support.

54 Claims, 3 Drawing Sheets

U.S. PATENT DOCUMENTS

| | | | | |
|---|---|---|---|---|
| 5,965,267 | A | 10/1999 | Nola et al. | |
| 6,053,176 | A | 4/2000 | Adams et al. | |
| 6,074,979 | A | 6/2000 | Hagemeyer et al. | |
| 6,083,467 | A | 7/2000 | Takeshima et al. | |
| 6,095,152 | A | 8/2000 | Beven et al. | |
| 6,132,694 | A | 10/2000 | Wood et al. | |
| 6,138,684 | A | 10/2000 | Yamazaki et al. | |
| 6,221,440 | B1 | 4/2001 | Meyer et al. | |
| 6,235,677 | B1 | 5/2001 | Manzer et al. | |
| 6,251,339 | B1 | 6/2001 | Beane et al. | |
| 6,262,129 | B1 | 7/2001 | Murray et al. | |
| 6,265,341 | B1 | 7/2001 | Komatsu et al. | |
| 6,276,132 | B1 | 8/2001 | Kanesaka et al. | |
| 6,286,516 | B1 | 9/2001 | Bowen et al. | |
| 6,299,778 | B1 | 10/2001 | Penth et al. | |
| 6,315,870 | B1 | 11/2001 | Tabatabaie-Raissi et al. | |
| 6,316,377 | B1 | 11/2001 | Fulton et al. | |
| 6,346,136 | B1 | 2/2002 | Chen et al. | |
| 6,348,431 | B1 | 2/2002 | Even et al. | |
| 6,353,037 | B1 | 3/2002 | Thunhorst et al. | |
| 6,371,127 | B1 | 4/2002 | Snaidr et al. | |
| 6,391,818 | B1 | 5/2002 | Bönsel et al. | |
| 6,391,821 | B1 | 5/2002 | Satoh et al. | |
| 6,410,765 | B1 | 6/2002 | Wellinghoff et al. | |
| 6,782,892 | B1 * | 8/2004 | Li et al. | 131/364 |
| 6,857,431 | B1 * | 2/2005 | Deevi et al. | 131/334 |
| 2002/0002979 | A1 | 1/2002 | Bowen et al. | |
| 2002/0062834 | A1 | 5/2002 | Snaidr et al. | |
| 2003/0000538 | A1 | 1/2003 | Bereman | |
| 2003/0037792 | A1 | 2/2003 | Snaidr et al. | |
| 2003/0131859 | A1 * | 7/2003 | Li et al. | 131/364 |
| 2004/0025895 | A1 * | 2/2004 | Li et al. | 131/364 |
| 2004/0173229 | A1 * | 9/2004 | Crooks et al. | 131/359 |
| 2005/0000530 | A1 * | 1/2005 | Snaidr et al. | 131/334 |

FOREIGN PATENT DOCUMENTS

| | | | |
|---|---|---|---|
| GB | 1204353 | A | 9/1970 |
| GB | 2013476 | A | 8/1979 |
| WO | 87/06104 | | 10/1987 |
| WO | 98/51401 | A1 | 11/1998 |
| WO | 99/16546 | A1 | 4/1999 |
| WO | 99/21652 | A2 | 5/1999 |
| WO | 00/09259 | A2 | 2/2000 |
| WO | 00/40104 | | 7/2000 |
| WO | 02/24005 | A2 | 3/2002 |
| WO | WO03/020058 | A | 3/2003 |
| WO | 03/086112 | A | 10/2003 |

OTHER PUBLICATIONS

International Preliminary Report on Patentability dated Dec. 13, 2006 for PCT/IB2004/002176.

* cited by examiner

CATALYST TO REDUCE CARBON MONOXIDE AND NITRIC OXIDE FROM THE MAINSTREAM SMOKE OF A CIGARETTE

FIELD OF THE INVENTION

The invention relates generally to methods for reducing constituents such as carbon monoxide in the mainstream smoke of a cigarette during smoking. More specifically, the invention relates to cut filler compositions, cigarettes, methods for making cigarettes and methods for smoking cigarettes, which involve the use of nanoparticle additives capable of reducing the amounts of various constituents in tobacco smoke.

BACKGROUND OF THE INVENTION

In the description that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art.

Smoking articles, such as cigarettes or cigars, produce both mainstream smoke during a puff and sidestream smoke during static burning. One constituent of both mainstream smoke and sidestream smoke is carbon monoxide (CO). The reduction of carbon monoxide in smoke is desirable.

Catalysts, sorbents, and/or oxidants for smoking articles are disclosed in the following: U.S. Pat. No. 6,371,127 issued to Snider et al., U.S. Pat. No. 6,286,516 issued to Bowen et al., U.S. Pat. No. 6,138,684 issued to Yamazaki et al., U.S. Pat. No. 5,671,758 issued to Rongved, U.S. Pat. No. 5,386,838 issued to Quincy, III et al., U.S. Pat. No. 5,211,684 issued to Shannon et al., U.S. Pat. No. 4,744,374 issued to Deffeves et al., U.S. Pat. No. 4,453,553 issued to Cohn, U.S. Pat. No. 4,450,847 issued to Owens, U.S. Pat. No. 4,182,348 issued to Seehofer et al., U.S. Pat. No. 4,108,151 issued to Martin et al., U.S. Pat. Nos. 3,807,416, and 3,720,214. Published applications WO 02/24005, WO 87/06104, WO 00/40104 and U.S. Patent Application Publication Nos. 2002/0002979 A1, 2003/0037792 A1 and 2002/0062834 A1 also refer to catalysts, sorbents, and/or oxidants.

Iron and/or iron oxide has been described for use in tobacco products (see e.g., U.S. Pat. Nos. 4,197,861; 4,489,739 and 5,728,462). Iron oxide has been described as a coloring agent (e.g. U.S. Pat. Nos. 4,119,104; 4,195,645; 5,284,166) and as a burn regulator (e.g. U.S. Pat. Nos. 3,931,824; 4,109,663 and 4,195,645) and has been used to improve taste, color and/or appearance (e.g. U.S. Pat. Nos. 6,095,152; 5,598,868; 5,129,408; 5,105,836 and 5,101,839).

Despite the developments to date, there remains a need for improved and more efficient methods and compositions for reducing the amount of carbon monoxide in the mainstream smoke of a smoking article during smoking.

SUMMARY

Tobacco cut filler compositions, cigarette fillers and/or cigarette paper, cigarettes, methods for making cigarettes and methods for smoking cigarettes that involve the use of catalysts for the conversion of carbon monoxide in mainstream smoke to carbon dioxide and/or the conversion of nitric oxide in mainstream smoke to nitrogen are provided.

One embodiment provides a cut filler composition comprising tobacco and a catalyst for the conversion of carbon monoxide in mainstream smoke to carbon dioxide and/or nitric oxide in mainstream smoke to nitrogen, wherein the catalyst comprises nanoscale metal particles and/or nanoscale metal oxide particles supported on a fibrous support.

Another embodiment provides a cigarette comprising cut filler and a catalyst capable of converting carbon monoxide in mainstream smoke to carbon dioxide and/or nitric oxide in mainstream smoke to nitrogen, wherein the catalyst comprises nanoscale metal particles and/or nanoscale metal oxide particles supported on a fibrous support.

A further embodiment provides a method of making a cigarette, comprising (i) adding a catalyst to tobacco cut filler, cigarette paper wrapper and/or a cigarette filter, wherein the catalyst comprises nanoscale metal particles and/or nanoscale metal oxide particles supported on a fibrous support; (ii) providing the cut filler to a cigarette making machine to form a tobacco rod; (iii) placing a paper wrapper around the tobacco column to form a tobacco rod; and (iv) optionally attaching a cigarette filter to the tobacco column to form a cigarette. Cigarettes produced according to the invention preferably comprise up to about 200 mg of the catalyst per cigarette or more.

In a preferred embodiment, the nanoscale metal particles and/or nanoscale metal oxide particles comprise metallic elements selected from the group consisting of Group IB–VIIB, VIII, IIIA and IVA elements of the Periodic Table of Elements, and mixtures thereof. For example, the nanoscale metal oxide particles can comprise iron oxide, iron oxyhydroxide and copper oxide, and mixtures thereof. The nanoscale metal particles and/or nanoscale metal oxide particles can have a specific surface area of from between about 20 to 2500 $m^2/g$, an average particle size of less than about 50 nm, preferably less than about 10 nm. While the nanoscale metal particles and/or nanoscale metal oxide particles can further comprise carbon, preferably the nanoscale metal particles and/or nanoscale metal oxide particles are carbon-free.

The fibrous support can comprise refractory carbides and oxides selected from the group consisting of oxide-bonded silicon carbide, boria, alumina, silica, aluminosilicates, titania, yttria, ceria, glasses, zirconia optionally stabilized with calcia or magnesia, and mixtures thereof. The fibrous support can have a specific surface area of about 0.1 to 200 $m^2/g$ and can comprise millimeter, micron, submicron and/or nanoscale fibers.

According to a preferred embodiment, the nanoscale metal oxide particles comprise iron oxide, iron oxyhydroxide, copper oxide, and mixtures thereof. The catalyst can be added to a cigarette in an amount effective to convert at least 10% of the carbon monoxide in the mainstream smoke to carbon dioxide and/or at least 10% of the nitric oxide in the mainstream smoke to nitrogen. Preferably, less than a monolayer of the nanoscale particles are deposited within and/or on the fibrous support. For example, the catalyst can comprise from 0.1 to 50 wt. % nanoscale particles supported on a fibrous support, the catalyst being present in the cut filler, cigarette paper and/or filter of the cigarette.

According to a preferred method, the catalyst is formed by (i) combining nanoscale metal particles and/or nanoscale metal oxide particles and a liquid to form a dispersion; (ii) combining the dispersion with a fibrous support; and (iii) heating the fibrous support to a remove the liquid and deposit nanoscale particles within and/or on the fibrous support.

According to another preferred method, the catalyst is formed by (i) combining a metal precursor and a solvent to form a metal precursor solution; (ii) contacting the fibrous support with the metal precursor solution; (iii) drying the fibrous support; and (iv) heating the fibrous support to a temperature sufficient to thermally decompose the metal precursor to form nanoscale particles within and/or on the fibrous support. For example, a dispersion of nanoscale particles or a metal precursor solution can be sprayed onto a fibrous support, preferably a heated fibrous support. Optionally, a dispersion of nanoscale particles can be added to the metal precursor solution.

The metal precursor can be one or more of metal β-diketonates, metal dionates, metal oxalates and metal hydroxides, and the metal in the metal precursor can comprise at least one element selected from Groups IB–VIIB, VIII, IIIA and IVA of the Periodic Table of Elements, and mixtures thereof. Liquids used to form a dispersion of nanoscale particles, and solvents used to form a metal precursor solution can include distilled water, pentanes, hexanes, aromatic hydrocarbons, cyclohexanes, xylenes, ethyl acetates, toluene, benzenes, tetrahydrofuran, acetone, carbon disulfide, dichlorobenzenes, nitrobenzenes, pyridine, methyl alcohol, ethyl alcohol, butyl alcohol, aldehydes, ketones, chloroform, mineral spirits, and mixtures thereof. The metal precursor can be decomposed to nanoscale metal and/or metal oxide particles by heating to a temperature of from about 200 to 400° C.

Yet another embodiment provides a method of smoking the cigarette described above, which involves lighting the cigarette to form smoke and drawing the smoke through the cigarette, wherein during the smoking of the cigarette, the catalyst acts as a catalyst for the conversion of carbon monoxide to carbon dioxide and/or nitric oxide to nitrogen.

DETAILED DESCRIPTION OF PREFERRED EMBODIMENTS

Figure 1:
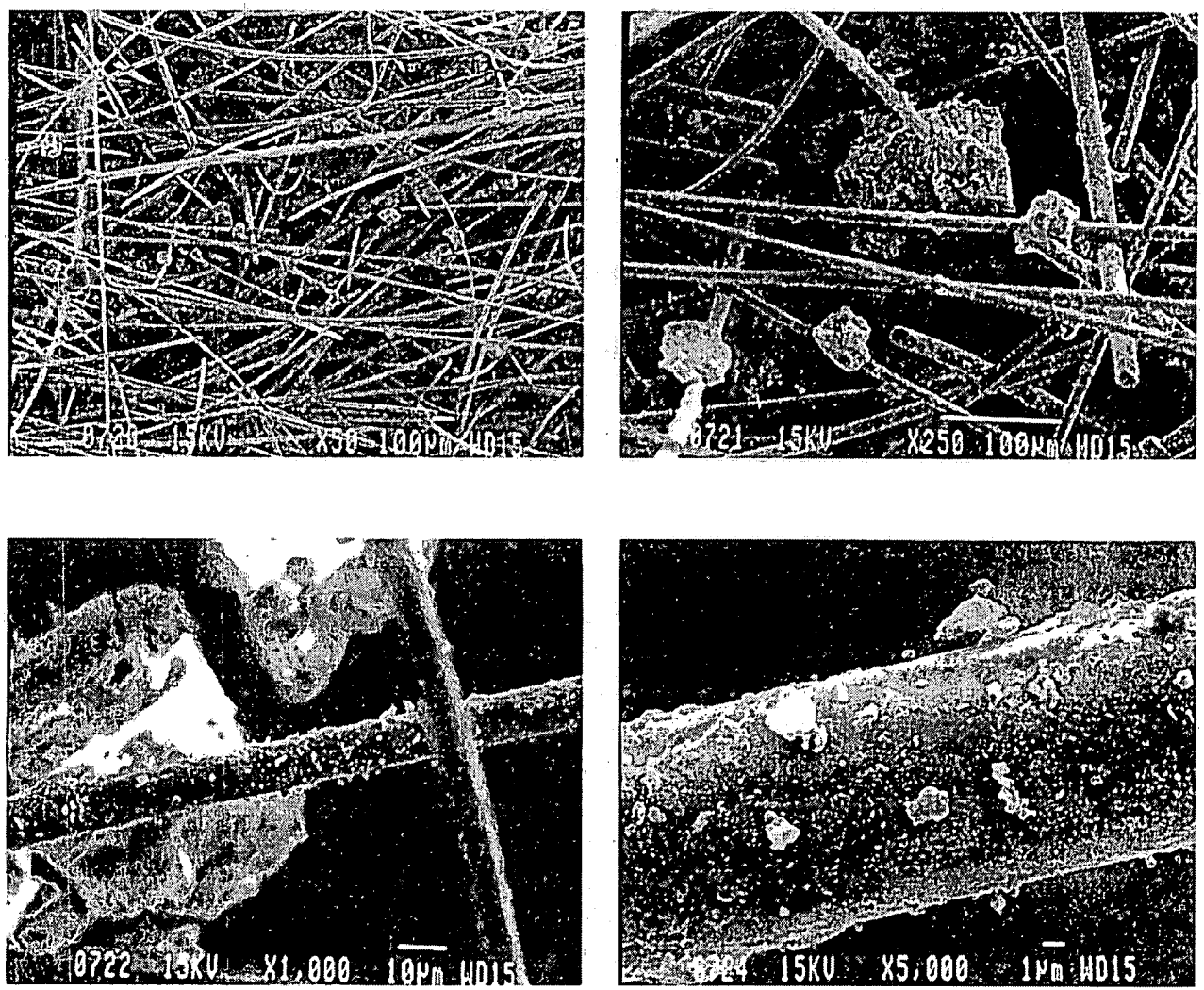
FIG. 1 shows SEM images of a catalyst prepared according to an embodiment of wherein nanoscale iron oxide particles are deposited on a fibrous quartz wool support.

Tobacco cut filler compositions, cigarettes, methods for making cigarettes and methods for smoking cigarettes that involve the use of catalysts having nanoscale metal particles and/or nanoscale metal oxide particles on a fibrous support capable of acting as a catalyst for the conversion of carbon monoxide (CO) to carbon dioxide ($CO_2$) and/or nitric oxide ($NO_x$) to nitrogen ($N_2$) are provided.

A catalyst is capable of affecting the rate of a chemical reaction, e.g., increasing the rate of oxidation of carbon monoxide to carbon dioxide and/or increasing the rate of reduction of nitric oxide to nitrogen without participating as a reactant or product of the reaction. An oxidant is capable of oxidizing a reactant, e.g., by donating oxygen to the reactant, such that the oxidant itself is reduced.

"Smoking" of a cigarette means the heating or combustion of the cigarette to form smoke, which can be drawn through the cigarette. Generally, smoking of a cigarette involves lighting one end of the cigarette and, while the tobacco contained therein undergoes a combustion reaction, drawing the cigarette smoke through the mouth end of the cigarette. The cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 and 5,322,075.

The term "mainstream" smoke refers to the mixture of gases passing down the tobacco rod and issuing through the filter end, i.e., the amount of smoke issuing or drawn from the mouth end of a cigarette during smoking of the cigarette.

In addition to the constituents in the tobacco, the temperature and the oxygen concentration within the cigarette during smoking are factors affecting the formation and reaction of carbon monoxide, nitric oxide and carbon dioxide. For example, the total amount of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition, which is largely controlled by chemical kinetics, starts at a temperature of about 180° C. and finishes at about 1050° C. Formation of carbon monoxide and carbon dioxide during combustion is controlled largely by the diffusion of oxygen to the surface ($k_a$) and via a surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above.

During smoking there are three distinct regions in a cigarette: the combustion zone, the pyrolysis/distillation zone, and the condensation/filtration zone. While not wishing to be bound by theory, it is believed that the catalyst of the invention can target the various reactions that occur in different regions of the cigarette during smoking.

First, the combustion zone is the burning zone of the cigarette produced during smoking of the cigarette, usually at the lighted end of the cigarette. The temperature in the combustion zone ranges from about 700° C. to about 950° C., and the heating rate can be as high as 500° C./second. Because oxygen is being consumed in the combustion of tobacco to produce carbon monoxide, carbon dioxide, nitric oxide, water vapor, and various organic compounds, the concentration of oxygen is low in the combustion zone. The low oxygen concentration coupled with the high temperature leads to the reduction of carbon dioxide to carbon monoxide by the carbonized tobacco. In this region, the catalyst can convert carbon monoxide to carbon dioxide via both catalysis and oxidation mechanisms, and the catalyst can convert nitric oxide to nitrogen via both catalysis and reduction mechanisms. The combustion zone is highly exothermic and the heat generated is carried to the pyrolysis/distillation zone.

The pyrolysis zone is the region behind the combustion zone, where the temperatures range from about 200° C. to about 600° C. The pyrolysis zone is where most of the carbon monoxide and nitric oxide is produced. The major reaction is the pyrolysis (i.e. the thermal degradation) of the tobacco that produces carbon monoxide, carbon dioxide, nitric oxide, smoke components, and charcoal using the heat generated in the combustion zone. There is some oxygen present in this region, and thus the catalyst may act as a catalyst for the oxidation of carbon monoxide to carbon dioxide and/or reduction of nitric oxide to nitrogen. The catalytic reaction begins at 150° C. and reaches maximum activity around 300° C.

In the condensation/filtration zone the temperature ranges from ambient to about 150° C. The major process in this zone is the condensation/filtration of the smoke components. Some amount of carbon monoxide, carbon dioxide and nitric oxide diffuse out of the cigarette and some oxygen diffuses into the cigarette. The partial pressure of oxygen in the condensation/filtration zone does not generally recover to the atmospheric level.

The catalyst comprises metal and/or metal oxide nanoscale particles supported on a fibrous support. The nanoscale particles can comprise metallic elements selected from the group consisting of Group IB–VIIB, VIII, IIIA and IVA elements of the Periodic Table of Elements, and mixtures thereof, e.g., B, C, Mg, Al, Si, Ti, V, Cr, Mn, Fe, Co, Ni, Cu, Zn, Ge, Y, Zr, Nb, Mo, Ru, Rh, Pd, Ag, Sn, Ce, Hf, Ta, W, Re, Os, Ir, Pt and Au. The fibrous support can comprise oxide-bonded silicon carbide, boria, alumina, silica, aluminosilicates, titania, yttria, ceria, glasses, zirconia optionally stabilized with calcia or magnesia, and mixtures thereof. While direct placement of the catalyst in the tobacco cut filler is preferred, the catalyst may be placed in the cigarette filter, or incorporated in the cigarette paper. The catalyst can also be placed both in the tobacco cut filler and in other locations.

Nanoscale particles are a novel class of materials whose distinguishing feature is that their average diameter, particle or other structural domain size is below about 100 nanometers. The nanoscale particles can have an average particle size less than about 100 nm, preferably less than about 50 nm, most preferably less than about 10 nm. Nanoscale particles have very high surface area to volume ratios, which makes them attractive for catalytic applications.

By dispersing nanoscale particles on a fibrous support the particles are easier to handle and easier to combine with tobacco cut filler than unsupported nanoscale particles. Through the method nanoscale particles can be combined with tobacco cut filler before and/or during incorporation of the tobacco cut filler into a cigarette. The fibrous support can act as a separator, which inhibits agglomeration or sintering together of the particles during combustion of the cut filler. Particle sintering may disadvantageously elongate the combustion zone, which can result in excess CO and $NO_x$ production. The fibrous support minimizes particle sintering, and thus minimizes elongation of the combustion zone and a loss of active surface area.

In order to maximize the amount of surface area of the nanoscale particles available for catalysis, preferably less than a monolayer of the nanoscale particles is deposited within and/or on the fibrous support. For example, the catalyst can comprise from about 0.1 to 50 wt. % nanoscale particles supported on a fibrous support. By adjusting the loading of the nanoscale particles on the fibrous support, the activities of the catalyst/oxidant can be regulated. By depositing less than a monolayer of nanoscale particles, neighboring nanoscale particles will be less likely to sinter together.

The synergistic combination of catalytically active nanoscale particles with a catalytically active fibrous support can produce a more efficient catalyst. Thus, nanoscale particles disposed on a fibrous support advantageously allow for the use of small quantities of catalyst to catalyze, for example, the oxidation of CO to $CO_2$ and/or reduction of $NO_x$ to $N_2$.

According to a preferred method, nanoscale metal particles and/or nanoscale metal oxide particles such as nanoscale copper oxide and/or nanoscale iron oxide particles can be dispersed in a liquid and intimately contacted with a fibrous support, which is dried to produce an intimate dispersion of nanoscale particles within or on the fibrous support.

According to another preferred method, nanoscale particles can be formed in situ upon heating a fibrous support that has been contacted with a metal precursor compound. For example, a metal precursor such as copper pentane dionate can be dissolved in a solvent such as alcohol and contacted with a fibrous support. The impregnated support can be heated to a relatively low temperature, for example 200–400° C., wherein thermal decomposition of the metal precursor results in the formation and deposition of nanoscale metal or metal oxide particles within or on the fibrous support.

An example of nanoscale metal oxide particles is iron oxide particles. For instance, MACH I, Inc., King of Prussia, Pa. sells $Fe_2O_3$ nanoscale particles under the trade names NANOCAT® Superfine Iron Oxide (SFIO) and NANOCAT® Magnetic Iron Oxide. The NANOCAT® Superfine Iron Oxide (SFIO) is amorphous ferric oxide in the form of a free flowing powder, with a particle size of about 3 nm, a specific surface area of about 250 $m^2/g$, and a bulk density of about 0.05 g/ml. The NANOCAT® Superfine Iron Oxide (SFIO) is synthesized by a vapor-phase process, which renders it free of impurities that may be present in conventional catalysts, and is suitable for use in food, drugs, and cosmetics. The NANOCAT® Magnetic Iron Oxide is a free flowing powder with a particle size of about 25 nm and a specific surface area of about 40 $m^2/g$.

The fibrous support can comprise a mixture of refractory carbides and oxides, including amorphous and crystalline forms of such fibrous materials. Exemplary classes of ceramic materials that can be used as a fibrous support include fused quartz and fused silica. Fused quartz and fused silica are ultra pure, single component glasses. Both fused quartz and fused silica are inert to most substances. Fused quartz is manufactured using powdered quartz crystal as a feedstock and is normally transparent, while fused silica products are generally produced from high purity silica sand. In both cases, the fusion process is carried out at high temperature (over 2000° C.) using any suitable heating technique such as an electrically powered furnace or flame fusion process.

The specific surface area of the fibers used as the fibrous support is preferably low, typically less than about 200 $m^2/g$, but greater than about 0.001 $m^2/g$, preferably between about 0.1 to 200 $m^2/g$. The length of the fibers is preferably greater than about 1 cm, e.g., greater than about 2.5 cm, but typically less than about 25 cm. Preferably, the fibers are not woven like cloth, but instead are randomly intertwined as in a non-woven mat or rug. Preferably, the fibers are catalytically active fibers.

Molecular organic decomposition (MOD) can be used to prepare nanoscale particles. The MOD process starts with a metal precursor containing the desired metallic element dissolved in a suitable solvent. For example, the process can involve a single metal precursor bearing one or more metallic atoms or the process can involve multiple single metallic precursors that are combined in solution to form a solution mixture. As described above, MOD can be used to prepare nanoscale metal particles and/or nanoscale metal oxide particles prior to adding the particles to the fibrous support, or in situ, by contacting a fibrous support with a metal precursor solution and thermally decomposing the metal precursor to give nanoscale particles.

The decomposition temperature of the metal precursor is the temperature at which the ligands substantially dissociate (or volatilize) from the metal atoms. During this process the bonds between the ligands and the metal atoms are broken such that the ligands are vaporized or otherwise separated from the metal. Preferably all of the ligand(s) decompose. However, nanoscale particles may also contain carbon obtained from partial decomposition of the organic or inorganic components present in the metal precursor and/or solvent.

The metal precursors used in MOD processing preferably are high purity, non-toxic, and easy to handle and store (with long shelf lives). Desirable physical properties include solubility in solvent systems, compatibility with other precursors for multi-component synthesis, and volatility for low temperature processing.

Multicomponent nanoscale particles can be obtained from mixtures of single metal (homo-metallic) precursors or from a single-source mixed metal (hetero-metallic) precursor molecule in which one or more metallic elements are chemically associated. The desired stoichiometry of the resultant particles can match the stoichiometry of the metal precursor solution.

In preparing multicomponent nanoscale particles, the use of different single-metal precursors has the advantage of flexibility in designing precursor rheology as well as product stoichiometry. Hetero-metallic precursors, on the other hand, may offer access to metal systems whose single metal precursors have undesirable solubility, volatility or compatibility.

Mixed-metal species can be obtained via Lewis acid-base reactions or substitution reactions by mixing metal alkoxides and/or other metal precursors such as acetates, β-diketonates or nitrates. Because the combination reactions are controlled by thermodynamics, however, the stoichiometry of the hetero-compound once isolated may not reflect the composition ratios in the mixture from which it was prepared. On the other hand, most metal alkoxides can be combined to produce hetero-metallic species that are often more soluble than the starting materials.

An aspect of the method described herein for making a catalyst is that a commercially desirable stoichiometry in the nanoscale particles can be obtained. For example, the desired atomic ratio in the nanoscale particles can be achieved by selecting a metal precursor or mixture of metal precursors having a ratio of first metal atoms to second metal atoms that is equal to the desired atomic ratio.

The metal precursor compounds are preferably metal organic compounds, which have a central main group, transition, lanthanide, or actinide metal or metalloid atom or atoms bonded to a bridging atom (e.g., N, O, P or S) that is in turn bonded to an organic radical. Examples of the central metal or metalloid atom include, but are not limited to, B, C, Mg, Al, Si, Ti, V, Cr, Mn, Fe, Co, Ni, Cu, Zn, Ge, Y, Zr, Nb, Mo, Ru, Rh, Pd, Ag, Sn, Ce, Hf, Ta, W, Re, Os, Ir, Pt and Au. Such metal compounds may include alkoxides, β-diketonates, carboxylates, oxalates, citrates, hydrides, thiolates, amides, nitrates, carbonates, cyanates, sulfates, bromides, chlorides, and hydrates thereof. The metal precursor can also be a so-called organometallic compound, wherein a central metal atom is bonded to one or more carbon atoms of an organic group. Aspects of processing with these metal precursors are discussed below.

Precursors for the synthesis of nanoscale oxides are molecules having pre-existing metal-oxygen bonds such as metal alkoxides $M(OR)_n$ or oxoalkoxides $MO(OR)_n$ ®=saturated or unsaturated organic group, alkyl or aryl), β-diketonates $M(\beta\text{-diketonate})_n$ (β-diketonate=RCOCHCOR') and metal carboxylates $M(O_2CR)_n$. Metal alkoxides have both good solubility and volatility and are readily applicable to MOD processing. Generally, however, these compounds are highly hygroscopic and require storage under inert atmosphere. In contrast to silicon alkoxides, which are liquids and monomeric, the alkoxides based on most metals are solids. On the other hand, the high reactivity of the metal-alkoxide bond can make these metal precursor materials useful as starting compounds for a variety of heteroleptic species (i.e., species with different types of ligands) such as $M(OR)_{n-x}Z_x$ (Z=β-diketonate or $O_2CR$).

Metal alkoxides $M(OR)_n$ react easily with the protons of a large variety of molecules. This allows easy chemical modification and thus control of stoichiometry by using, for example, organic hydroxy compounds such as alcohols, silanols ($R_3SiOH$), glycols $OH(CH_2)_nOH$, carboxylic and hydroxycarboxylic acids, hydroxyl surfactants, etc.

Fluorinated alkoxides $M(OR_F)_n$ ($R_F$=$CH(CF_3)_2$, $C_6F_5$, . . . ) are readily soluble in organic solvents and less susceptible to hydrolysis than non-fluorinated alkoxides. These materials can be used as precursors for fluorides, oxides or fluoride-doped oxides such as F-doped tin oxide, which can be used as nanoscale metal oxide particles.

Modification of metal alkoxides reduces the number of M-OR bonds available for hydrolysis and thus hydrolytic susceptibility. Thus, it is possible to control the solution chemistry in situ by using, for example, metal β-diketonates (e.g. acetylacetone) or carboxylic acids (e.g. acetic acid) as modifiers for, or in lieu of, the alkoxide.

Metal β-diketonates $[M(RCOCHCOR')_n]_m$ are attractive precursors for MOD processing because of their volatility and high solubility. Their volatility is governed largely by the bulk of the R and R' groups as well as the nature of the metal, which will determine the degree of association, m, represented in the formula above. Acetylacetonates (R=R'=$CH_3$) are advantageous because they can provide good yields.

Metal β-diketonates are prone to a chelating behavior that can lead to a decrease in the nuclearity of these precursors. These ligands can act as surface capping reagents and polymerization inhibitors. Thus, small particles can be obtained after hydrolysis of $M(OR)_{n-x}(\beta\text{-diketonate})_x$. Acetylacetone can, for instance, stabilize nanoscale colloids. Thus, metal β-diketonate precursors are preferred for preparing nanoscale particles.

Metal carboxylates such as acetates ($M(O_2CMe)_n$) are commercially available as hydrates, which can be rendered anhydrous by heating with acetic anhydride or with 2-methoxyethanol. Many metal carboxylates generally have poor solubility in organic solvents and, because carboxylate ligands act mostly as bridging-chelating ligands, readily form oligomers or polymers. However, 2-ethylhexanoates ($M(O_2CCHEt_nBu)_n$), which are the carboxylates with the smallest number of carbon atoms, are generally soluble in most organic solvents. A large number of carboxylate derivatives are available for aluminum. Nanoscale aluminum-oxygen macromolecules and clusters (alumoxanes) can be used as nanoscale particles. For example, formate $Al(O_2CH)_3(H_2O)$ and carboxylate-alumoxanes $[AlO_x(OH)_y(O_2CR)_z]_m$ can be prepared from the inexpensive minerals gibsite or boehmite.

The solvent(s) used in MOD processing are selected based on a number of criteria including high solubility for the metal precursor compounds; chemical inertness to the metal precursor compounds; rheological compatibility with the deposition technique being used (e.g., the desired viscosity, wettability and/or compatibility with other rheology adjusters); boiling point; vapor pressure and rate of vaporization; and economic factors (e.g. cost, recoverability, toxicity, etc.).

Solvents that may be used in MOD processing include distilled water, pentanes, hexanes, aromatic hydrocarbons, cyclohexanes, xylenes, ethyl acetates, toluene, benzenes, tetrahydrofuran, acetone, carbon disulfide, dichlorobenzenes, nitrobenzenes, pyridine, methyl alcohol, ethyl alcohol, butyl alcohol, aldehydes, ketones, chloroform, mineral spirits, and mixtures thereof.

Nanoscale metal particles may be incorporated into the fibrous support by methods known in the art, such as ion exchange, impregnation, or physical admixture. For example, nanoscale particles and/or a metal precursor may be suspended or dissolved in a liquid, and the fibrous support may be contacted, mixed or sprayed with the liquid having the dispersed particles and/or dissolved metal precursor. The fibrous support can be dried and/or heat treated during or after the coating step.

According to a first embodiment, a liquid dispersion of nanoscale particles can be combined with a fibrous support. Nanoscale particles may be suspended or dissolved in a liquid, and the fibrous support may be mixed or sprayed with the liquid having the dispersed particles. The liquid may be substantially removed from the fibrous support, such as by heating the fibrous support at a temperature higher than the boiling point of the liquid or by reducing the pressure of the atmosphere surrounding the fibrous support so that the particles remain on the support. The liquid used to form a dispersion of the nanoscale particles can include distilled water, pentanes, hexanes, aromatic hydrocarbons, cyclohexanes, xylenes, ethyl acetates, toluene, benzenes, tetrahydrofuran, acetone, carbon disulfide, dichlorobenzenes, nitrobenzenes, pyridine, methyl alcohol, ethyl alcohol, butyl alcohol, aldehydes, ketones, chloroform, mineral spirits, and mixtures thereof.

In general, nanoscale particles and a fibrous support can be combined in any suitable ratio to give a desired loading of metal particles on the support. For example, nanoscale iron oxide particles or copper oxide particles can be combined with ceramic fibers to produce from about 0.1% to 50% wt. %, e.g. 10 wt. % or 20 wt. % nanoscale particles of iron oxide or copper oxide on ceramic fibers.

By way of example, a 5 wt. % mixture of NANOCAT® iron oxide particles was dispersed in distilled water using ultrasonication. The dispersion was sprayed onto a 200 mg quartz wool support that was heated to about 50° C. during the coating step and then dried in air to give a catalyst comprising 100 mg nanoscale iron oxide on the quartz wool. SEM images of the resulting catalyst are shown in FIG. 1. The catalyst was incorporated into the cut filler of an experimental cigarette that was smoked under continuous draw conditions at a flow rate of 500 ml/min. A multi-gas analyzer was used to measure CO and NO. The amount of CO and NO drawn through the experimental cigarette was compared with the amount drawn through a catalyst-free control cigarette. The data in Table 1 illustrate the improvement obtained by using a nanoscale particles/quartz wool catalyst.

TABLE 1

Reduction of CO and NO using NANOCAT/quartz wool catalyst.

| | CO (mg) | NO (mg) |
|---|---|---|
| Control | 23.7 | 0.233 |
| Experimental | 10.5 | 0.167 |
| Reduction (%) | 55.7 | 28.3 |

According to a second embodiment, nanoscale particles can be formed in situ on a fibrous support via the thermal decomposition of a metal precursor compound. Suitable precursor compounds for the metal, or metal oxide nanoscale particles are those that thermally decompose at relatively low temperatures, such as discussed above. The concentration of the metal precursor in the solvent generally ranges from about 0.001 molar (M) to 10 M, preferably from about 0.1 to 1 M. The metal precursor solution and fibrous support can be combined at about ambient temperature, e.g., by spraying or dip coating, or at elevated temperatures, e.g., through reflux. The temperature of the mixing typically ranges from about ambient, e.g., 23° C. to about 50° C. The mixing is preferably conducted at ambient pressure.

After contacting the fibers with the solution containing the metal precursor, the fibrous support material can be dried in air at a temperature ranging from about 23° C. to a temperature below the decomposition temperature of the metal precursor, typically a temperature between about 23° C. and 100° C. According to one preferred embodiment, the dried precursor-fibrous support can be heated (e.g., above 100° C.) to decompose the metal precursor and form a catalyst material comprising nanoscale particles on the fibrous support. According to another embodiment, the dried precursor-fibrous support can be combined with cut filler.

The metal precursor can be decomposed to form nanoscale particles that are dispersed within or on the fibrous support by thermally treating the metal precursor to above its decomposition temperature. Thermal treatment causes decomposition of the metal precursor to dissociate the constituent metal atoms, whereby the metal atoms may combine to form nanoscale metal or metal oxide particles. Where the metal precursor comprises more than one metallic element, the nanoscale particles may have an atomic ratio approximately equal to the stoichiometric ratio of the metals in the metal precursor solution.

The thermal treatment can be carried out in various atmospheres. For instance, the fibrous support can be contacted with a metal precursor solution and the contacted support can be heated in the presence of an oxidizing atmosphere and then heated in the substantial absence of an oxidizing atmosphere to form nanoscale metal oxide particles. The oxidizing atmosphere can comprise air or oxygen. Alternatively, the fibrous support can be contacted with a metal precursor solution and the contacted support can be heated in an inert or reducing atmosphere to form nanoscale metal particles. The reducing atmosphere can comprise hydrogen, nitrogen, ammonia, carbon dioxide and mixtures thereof. A preferred reducing atmosphere is a hydrogen-nitrogen mixture (e.g., forming gas).

The metal precursor-contacted support is preferably heated to a temperature equal to or greater than the decomposition temperature of the metal precursor. The preferred heating temperature will depend on the particular ligands used as well as on the degradation temperature of the metal(s) and any other desired groups which are to remain. However, the preferred temperature is from about 200° C. to 400° C., for example 300° C. or 350° C. Thermal decomposition of the uniformly dispersed metal precursor preferably results in the uniform deposition of nanoscale particles within and/or on the surface of the fibrous support.

By way of example, nanoscale copper oxide particles were formed on quartz wool by uniformly mixing quartz wool with a 0.5 M solution of copper pentane dionate in alcohol to the point of incipient wetness. The support was dried at room temperature overnight and then heated to 400° C. in air to form a catalyst material comprising nanoscale copper oxide particles that were intimately coated/mixed with the quartz wool.

In general, a metal precursor and a fibrous support can be combined in any suitable ratio to give a desired loading of metal particles on the support. For example, iron oxalate or copper pentane dionate can be combined with quartz wool to produce from about 0.1% to 50% wt. %, e.g., 10 wt. % or 20 wt. % nanoscale particles of iron oxide, iron oxyhydroxide or copper oxide on quartz wool.

The fibrous support may include any thermally stable/fire resistant material which, when heated to a temperature at which a metal precursor is converted to a metal on the surface thereof, does not melt, vaporize completely, or otherwise become incapable of supporting nanoscale particles.

During the conversion of CO to $CO_2$, the oxide nanoscale particles may become reduced. For example, nanoscale $Fe_2O_3$ particles may be reduced to $Fe_3O_4$, FeO or Fe during the reaction of CO to $CO_2$. The fibrous support advantageously acts as a spacer between the nanoscale particles and prevents them from sintering together, which would result in a loss of surface area and catalytic activity.

Iron oxide is a preferred constituent in the catalyst because it may have a dual function as a CO catalyst in the presence of oxygen, and as a CO and/or NO oxidant for the direct oxidation of CO in the absence of oxygen and/or reduction of NO. A catalyst that can also be used as an oxidant is especially useful for certain applications, such as within a burning cigarette where the partial pressure of oxygen can be very low.

Figure 2:
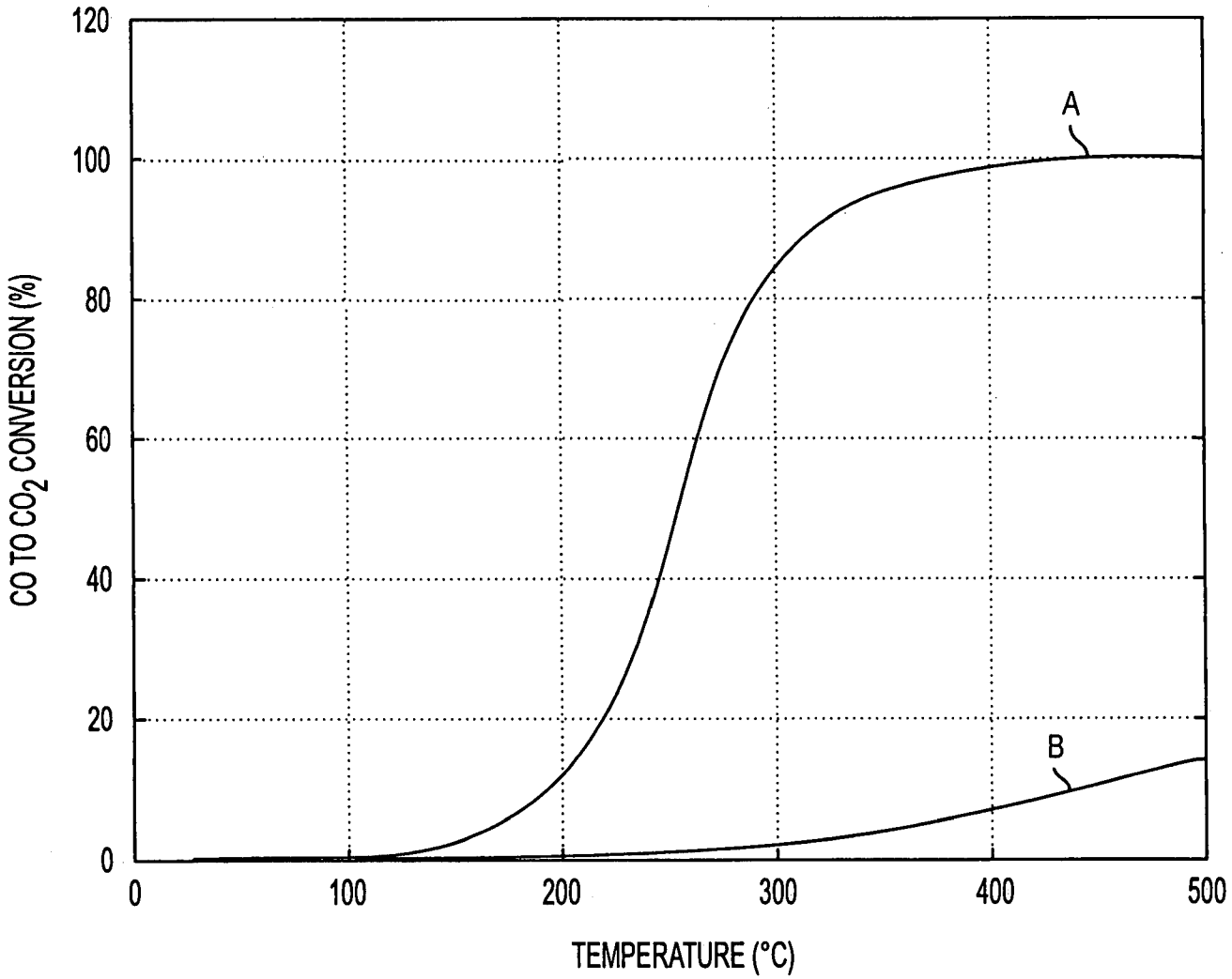
FIG. 2 depicts a comparison between the catalytic activity of $Fe_2O_3$ nanoscale particles (NANOCAT® Superfine Iron Oxide (SFIO) from MACH I, Inc., King of Prussia, Pa.) having an average particle size of about 3 nm, versus $Fe_2O_3$ powder (from Aldrich Chemical Company) having an average particle size of about 5 μm.

FIG. 2 shows a comparison between the catalytic activity of $Fe_2O_3$ nanoscale particles (50 mg samples) (NANOCAT® Superfine Iron Oxide (SFIO) from MACH I, Inc., King of Prussia, Pa.) having an average particle size of about 3 nm (curve A), versus $Fe_2O_3$ powder (from Aldrich Chemical Company) having an average particle size of about 5 μm (curve B). The gas (3.4% CO, 20.6% $O_2$, balance He) flow rate was 1000 ml/min. and the heating rate was 12 K/min. The $Fe_2O_3$ nanoscale particles show a much higher percentage of conversion of carbon monoxide to carbon dioxide than the larger $Fe_2O_3$ particles.

As mentioned above, $Fe_2O_3$ nanoscale particles are capable of acting as both an oxidant for the conversion of carbon monoxide to carbon dioxide and as a catalyst for the conversion of carbon monoxide to carbon dioxide and/or nitric oxide to nitrogen. For example, the $Fe_2O_3$ nanoscale particles can act as a catalyst in the pyrolysis zone and can act as an oxidant in the combustion zone.

Nanoscale iron oxide particles can act as a catalyst for the conversion of CO to $CO_2$ according to the equation $2CO+O_2 \rightarrow 2CO_2$ and for the conversion of NO to $N_2$ according to the equation $CO+2NO \rightarrow N_2+CO_2$. Nanoscale iron oxide particles can act as a oxidant for the conversion of CO to $CO_2$ according to the equation $CO+Fe_2O_3 \rightarrow CO_2+2FeO$.

Figure 3:
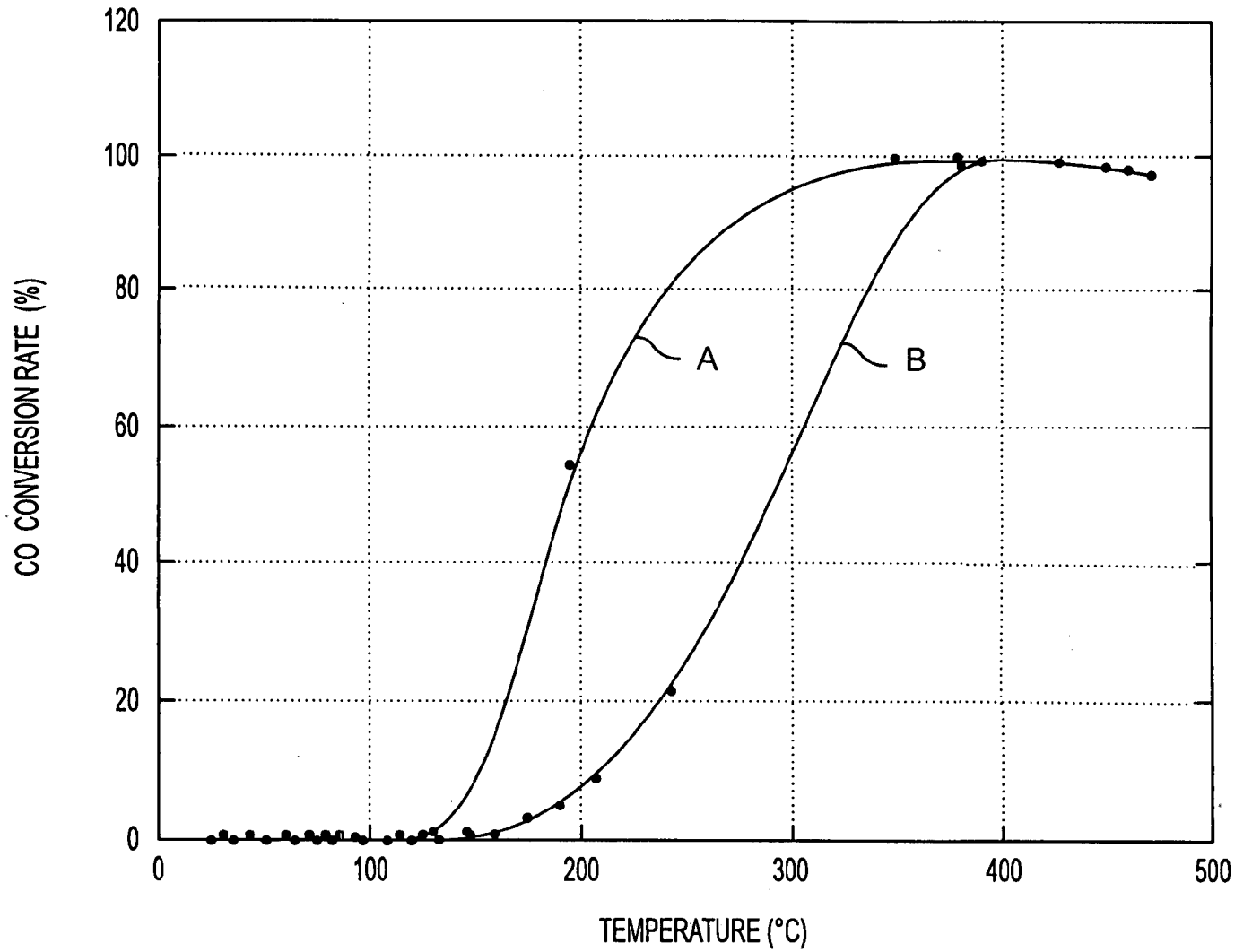
FIG. 3 depicts the temperature dependence for the conversion rates of CuO and $Fe_2O_3$ nanoscale particles as catalysts for the oxidation of carbon monoxide with oxygen to produce carbon dioxide.

To illustrate the effectiveness of nanoscale metal oxide, FIG. 3 illustrates a comparison between the temperature dependence of conversion rate for CuO (curve A) and $Fe_2O_3$ (curve B) nanoscale particles using 50 mg CuO particles and 50 mg $Fe_2O_3$ nanoscale particles as a catalyst in a quartz tube reactor. The gas (3.4% CO, 21% $O_2$, balance He) flow rate was 1000 ml/min. and the heating rate was 12.4 K/min. Although the CuO nanoscale particles have higher conversion rates at lower temperatures, at higher temperatures the CuO and $Fe_2O_3$ have comparable conversion rates.

Table 2 shows a comparison between the ratio of carbon monoxide to carbon dioxide, and the percentage of oxygen depletion when using CuO and $Fe_2O_3$ nanoscale particles.

TABLE 2

Comparison between CuO and $Fe_2O_3$ nanoscale particles

| Nanoscale particle | $CO/CO_2$ | $O_2$ Depletion (%) |
|---|---|---|
| None | 0.51 | 48 |
| CuO | 0.29 | 67 |
| $Fe_2O_3$ | 0.23 | 100 |

In the absence of nanoscale particles, the ratio of carbon monoxide to carbon dioxide is about 0.51 and the oxygen depletion is about 48%. The data in Table 2 illustrate the improvement obtained by using nanoscale particles. The ratio of carbon monoxide to carbon dioxide drops to 0.29 and 0.23 for CuO and $Fe_2O_3$ nanoscale particles, respectively. The oxygen depletion increases to 67% and 100% for CuO and $Fe_2O_3$ nanoscale particles, respectively.

The catalysts will preferably be distributed throughout the tobacco rod portion of a cigarette. By providing the catalysts throughout the tobacco rod, it is possible to reduce the amount of carbon monoxide and/or nitric oxide drawn through the cigarette, and particularly at both the combustion region and in the pyrolysis zone.

The catalysts, which comprise nanoscale particles supported on a fibrous support, may be provided along the length of a tobacco rod by distributing the catalysts on the tobacco or incorporating them into the cut filler tobacco. The catalysts may also be added to the cut filler tobacco stock supplied to the cigarette making machine or added to a tobacco rod prior to wrapping cigarette paper around the cigarette rod. According to a preferred embodiment, when nanoscale particles are formed in situ using MOD processing as described above, heating the fibrous support comprising a metal precursor solution to a temperature sufficient to thermally decompose the metal precursor into nanoscale particles can be performed prior to adding the impregnated support to the cigarette.

The amount of the catalyst can be selected such that the amount of carbon monoxide and/or nitric oxide in mainstream smoke is reduced during smoking of a cigarette. Preferably, the amount of the catalyst will be a catalytically effective amount, e.g., from about a few milligrams, for example, 5 mg/cigarette, to about 200 mg/cigarette or more.

One embodiment provides a cut filler composition comprising tobacco and at least one catalyst, as described above, which is capable of converting carbon monoxide to carbon dioxide and/or nitric oxide to nitrogen, where the catalyst is in the form of a nanoscale metal particles and/or nanoscale metal oxide particles supported on a fibrous support.

Any suitable tobacco mixture may be used for the cut filler. Examples of suitable types of tobacco materials include flue-cured, Burley, Md. or Oriental tobaccos, the rare or specialty tobaccos, and blends thereof. The tobacco material can be provided in the form of tobacco lamina, processed tobacco materials such as volume expanded or puffed tobacco, processed tobacco stems such as cut-rolled or cut-puffed stems, reconstituted tobacco materials, or blends thereof. The tobacco can also include tobacco substitutes.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g. burn additives, combustion modifying agents, coloring agents, binders, etc.) known in the art.

Another embodiment provides a cigarette comprising a tobacco rod, wherein the tobacco rod comprises tobacco cut filler having at least one catalyst, as described above, which is capable of converting carbon monoxide to carbon dioxide and/or nitric oxide to nitrogen. In addition to being located in the tobacco cut filler, the catalyst can be located in the cigarette paper and/or filter of the cigarette.

A further embodiment provides a method of making a cigarette, comprising (i) adding a catalyst to a tobacco cut filler, cigarette paper and/or a cigarette filter; (ii) providing the cut filler to a cigarette making machine to form a tobacco column; (iii) placing a paper wrapper around the tobacco column to form a tobacco rod; and (iv) optionally attaching a cigarette filter to the tobacco rod to form a cigarette.

Techniques for cigarette manufacture are known in the art. Any conventional or modified cigarette making technique may be used to incorporate the catalysts. The resulting cigarettes can be manufactured to any known specifications using standard or modified cigarette making techniques and equipment. Typically, the cut filler composition is optionally combined with other cigarette additives, and provided to a cigarette making machine to produce a tobacco rod, which is then wrapped in cigarette paper, and optionally tipped with filters.

Cigarettes may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The tobacco packing density is typically between the range of about 100 mg/cm$^3$ to about 300 mg/cm$^3$, and preferably 150 mg/cm$^3$ to about 275 mg/cm$^3$.

Yet another embodiment provides a method of smoking the cigarette described above, which involves lighting the cigarette to form smoke and drawing the smoke through the cigarette, wherein during the smoking of the cigarette, the catalyst acts as a catalyst for the conversion of carbon monoxide to carbon dioxide and/or nitric oxide to nitrogen.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

What is claimed is:

1. A cut filler composition comprising tobacco and a catalyst for the conversion of carbon monoxide in mainstream smoke to carbon dioxide and/or nitric oxide in mainstream smoke to nitrogen, wherein the catalyst comprises nanoscale metal particles and/or nanoscale metal oxide particles, and wherein the catalyst is supported on a fibrous support comprising ceramic and/or glass fibers.

2. The cut filler composition of claim 1, wherein the nanoscale metal particles and/or nanoscale metal oxide particles comprise one or more metallic elements selected from the group consisting of Group IB, IIB, IIIB, IVB, VB, VIB, VIIB, VIII, IIIA and IVA elements of the Periodic Table of Elements.

3. The cut filler composition of claim 1, wherein the nanoscale metal oxide particles comprise oxides selected from the group consisting of iron oxide, iron oxyhydroxide, copper oxide, and mixtures thereof.

4. The cut filler composition of claim 1, wherein the nanoscale metal particles and/or nanoscale metal oxide particles are carbon-free.

5. The cut filler composition of claim 1, wherein the specific surface area of the nanoscale metal particles and/or nanoscale metal oxide particles is from about 20 to 2500 m$^2$/g.

6. The cut filler composition of claim 1, wherein the nanoscale metal particles and/or nanoscale metal oxide particles have an average particle size less than about 50 nm.

7. The cut filler composition of claim 1, wherein the nanoscale metal particles and/or nanoscale metal oxide particles have an average particle size less than about 10 nm.

8. The cut filler composition of claim 1, wherein the fibrous support is selected from the group consisting of oxide-bonded silicon carbide, boria, alumina, silica, aluminosilicates, titania, yttria, ceria, glasses, zirconia optionally stabilized with calcia or magnesia, and mixtures thereof.

9. The cut filler composition of claim 1, wherein the specific surface area of the fibrous support is from about 0.1 to 200 m$^2$/g.

10. The cut filler composition of claim 1, wherein the fibrous support comprises millimeter, micron, submicron and/or nanoscale fibers.

11. The cut filler composition of claim 1, wherein the fibrous support comprises catalytically active fibers.

12. The cut filler composition of claim 1, wherein the nanoscale metal oxide particles comprise iron oxide and the fibrous support comprises ceramic fibers and/or glass fibers, the catalyst being present in the cut filler in an amount effective to convert at least 10% of the carbon monoxide in the mainstream smoke to carbon dioxide and/or at least 10% of the nitric oxide in the mainstream smoke to nitrogen.

13. The cut filler composition of claim 1, wherein less than a monolayer of the nanoscale particles are deposited within and/or on the fibrous support.

14. The cut filler composition of claim 1, wherein the catalyst comprises from 0.1 to 50 wt. % nanoscale particles supported on a fibrous support.

15. A cigarette comprising:

cut filler, wherein the cut filler comprises tobacco; and a catalyst capable of acting as a catalyst for the conversion of carbon monoxide to carbon dioxide and/or nitric oxide to nitrogen, wherein the catalyst comprises a glass or ceramic fiber containing fibrous support and nanoscale metal particles and/or nanoscale metal oxide particles supported on the fibrous support, wherein the nanoscale metal particles comprise B, C, Mg, Al, Si, Ti, V, Cr, Mn, Fe, Co, Ni, Zn, Ge, Y, Zr, Nb, Mo, Ru, Rh, Pd, Ag, Sn, Hf, Ta, W, Re, Os, Ir, Pt, Au, or combinations thereof, wherein the nanoscale metal oxide particles comprise oxides of B, C, Mg, Al, Si, Ti, V, Cr, Mn, Fe, Co, Ni, Zn, Ge, Y, Zr, Nb, Mo, Ru, Rh, Pd, Ag, Sn, Hf, Ta, W, Re, Os, Ir, Pt, Au, or combinations thereof, and wherein the catalyst is in the cut filler or a filter portion of the cigarette.

16. The cigarette of claim 15, wherein the nanoscale metal oxide particles comprise oxides selected from the group consisting of iron oxide, iron oxyhydroxide and copper oxide, and mixtures thereof.

17. The cigarette of claim 15, wherein the nanoscale metal particles and/or nanoscale metal oxide particles are carbon-free, and/or wherein the fibrous support comprises glass fibers.

18. The cigarette of claim 15, wherein the specific surface area of the nanoscale metal particles and/or nanoscale metal oxide particles is from about 20 to 2500 $m^2/g$.

19. The cigarette of claim 15, wherein the nanoscale metal particles and/or nanoscale metal oxide particles have an average particle size less than about 50 nm.

20. The cigarette of claim 15, wherein the nanoscale metal particles and/or nanoscale metal oxide particles have an average particle size less than about 10 nm.

21. The cigarette of claim 15, wherein the fibrous support comprises oxides selected from the group consisting of oxide-bonded silicon carbide, boria, alumina, silica, aluminosilicates, titania, yttria, ceria, glasses, zirconia optionally stabilized with calcia or magnesia, and mixtures thereof.

22. A cigarette comprising cut filler, wherein the cut filler comprises tobacco and a catalyst capable of acting as a catalyst for the conversion of carbon monoxide to carbon dioxide and/or nitric oxide to nitrogen, wherein the catalyst comprises a fibrous support and nanoscale metal particles and/or nanoscale metal oxide particles supported on the fibrous support, wherein the nanoscale metal particles comprise B, C, Mg, Al, Si, Ti, V, Cr, Mn, Fe, Co, Ni, Zn, Ge, Y, Zr, Nb, Mo, Ru, Rh, Pd, Ag, Sn, Hf, Ta, W, Re, Os, Ir, Pt, Au, or combinations thereof, and wherein the nanoscale metal oxide particles comprise oxides of B, C, Mg, Al, Si, Ti, V, Cr, Mn, Fe, Co, Ni, Zn, Ge, Y, Zr, Nb, Mo, Ru, Rh, Pd, Ag, Sn, Hf, Ta, W, Re, Os, Ir, Pt, Au, or combinations thereof, wherein the fibrous support comprises ceramic fibers and/or glass fibers and/or wherein the specific surface area of the fibrous support is from about 0.1 to 200 $m^2/g$, and/or wherein the fibrous support comprises millimeter, micron, submicron and/or nanoscale fibers, and/or wherein the fibrous support comprises catalytically active fibers, and/or wherein the cigarette comprises up to about 200 mg of the catalyst per cigarette.

23. The cigarette of claim 15, wherein the specific surface area of the fibrous support is from about 0.1 to 200 $m^{2/g}$.

24. The cigarette of claim 15, wherein the fibrous support comprises millimeter, micron, submicron and/or nanoscale fibers.

25. The cigarette of claim 15, wherein the fibrous support comprises catalytically active fibers.

26. The cigarette of claim 15, wherein the nanoscale metal oxide particles comprise iron oxide, the catalyst being present in the cigarette in an amount effective to convert at least 10% of the carbon monoxide in the mainstream smoke to carbon dioxide and/or at least 10% of the nitric oxide in the mainstream smoke to nitrogen.

27. The cigarette of claim 15, wherein less than a monolayer of the nanoscale particles are deposited within and/or on the fibrous support.

28. The cigarette of claim 15, wherein the catalyst comprises from 0.1 to 50 wt. % nanoscale particles supported on a fibrous support.

29. The cigarette of claim 15, wherein the cigarette comprises up to about 200 mg of the catalyst per cigarette.

30. A method of making a cigarette, comprising: (i) adding a catalyst to tobacco cut filler, cigarette paper wrapper and/or a cigarette filter, wherein the catalyst comprises nanoscale metal particles and/or nanoscale metal oxide particles supported on a fibrous support comprising ceramic and/or glass fibers; (ii) providing the cut filler to a cigarette making machine to form a tobacco column; (iii) placing a paper wrapper around the tobacco column to form a tobacco rod; and (iv) optionally attaching a cigarette filter to the tobacco rod to form a cigarette.

31. The method of claim 30, comprising combining nanoscale metal particles and/or nanoscale metal oxide particles comprising one or more metallic elements selected from the group consisting of Group IB, IIB, IIIB, IVB, VB, VIB, VIIB, VIII, IIIA and IVA elements of the Periodic Table of Elements and a fibrous support comprising oxides selected from the group consisting of oxide-bonded silicon carbide, boria, alumina, silica, aluminosilicates, titania, yttria, ceria, glasses, zirconia optionally stabilized with calcia or magnesia, and mixtures thereof to form the catalyst.

32. The method of claim 30, comprising combining nanoscale metal oxide particles comprising iron oxide, iron oxyhydroxide, copper oxide, and mixtures thereof and a fibrous support to form the catalyst.

33. The method of claim 30, wherein less than a monolayer of the nanoscale particles are deposited within and/or on the fibrous support.

34. The method of claim 30, comprising adding a catalyst having from about 0.1 to 50 wt. % nanoscale particles supported on a fibrous support to the tobacco cut filter, cigarette paper wrapper and/or cigarette filter.

35. The method of claim 30, wherein the catalyst is added to the cut filler and the cigarette produced comprises 200 mg or less of the catalyst per cigarette.

36. The method of claim 30, wherein the catalyst is combined with the cigarette in an amount effective to convert at least 10% of the carbon monoxide in the mainstream smoke to carbon dioxide and/or at least 10% of the nitric oxide in the mainstream smoke to nitrogen.

37. A method of making a cigarette, comprising: (i) adding a catalyst to tobacco cut filler, cigarette paper wrapper and/or a cigarette filter, wherein the catalyst comprises nanoscale metal particles and/or nanoscale metal oxide particles supported on a fibrous support; (ii) providing the cut filler to a cigarette making machine to form a tobacco column; (iii) placing a paper wrapper around the tobacco column to form a tobacco rod; and (iv) optionally attaching a cigarette filter to the tobacco rod to form a cigarette, and further comprising forming the catalyst by: combining a metal precursor and a solvent to form a metal precursor solution; contacting a fibrous support with the metal precursor solution; drying the fibrous support; and heating the fibrous support to a temperature sufficient to thermally decompose the metal precursor to form nanoscale particles that are deposited within and/or on the fibrous support.

38. The method of claim 37, comprising combining a metal precursor having at least one metal selected from the group consisting of Group IB, IIB, IIIB, IVB, VB, VIB, VIIB, VIII, IIIA and IVA elements of the Periodic Table of Elements with the solvent to form the metal precursor solution.

39. The method of claim 37, comprising heating the fibrous support to a temperature sufficient to form nanoscale metal particles and/or nanoscale metal oxide particles having an average particle size less than about 50 nm.

40. The method of claim 37, comprising combining a fibrous support selected from the group consisting of oxide-bonded silicon carbide, boria, alumina, silica, aluminosilicates, titania, yttria, ceria, glasses, zirconia optionally stabilized with calcia or magnesia, and mixtures thereof with the metal precursor solution.

41. The method of claim 37, comprising combining a fibrous support having millimeter, micron, submicron and/or nanoscale fibers and/or catalytically active fibers with the metal precursor solution.

42. The method of claim 37, comprising combining a fibrous support comprising glass fibers and/or ceramic fibers with the metal precursor solution.

43. The method of claim 37, comprising combining a metal powder comprising iron with the solvent to form the metal precursor solution.

44. The method of claim 37, comprising combining a solvent selected from the group consisting of distilled water, ethyl alcohol, methyl alcohol, chloroform, aldehydes, ketones, aromatic hydrocarbons and mixtures thereof with the metal precursor.

45. The method of claim 37, wherein the metal precursor solution is sprayed onto a heated fibrous support.

46. The method of claim 37, further comprising adding a dispersion of nanoscale particles to the metal precursor solution.

47. The method of claim 37, comprising combining a metal precursor selected from the group consisting of metal b-diketonates, metal dionates, metal oxalates, metal hydroxides and mixtures thereof with the solvent.

48. The method of claim 37, wherein the metal precursor is decomposed to nanoscale metal and/or metal oxide particles by heating to a temperature of from about 200 to 400° C.

49. The method of claim 37, wherein the metal precursor is decomposed to form nanoscale metal particles and/or nanoscale metal oxide particles that are carbon-free.

50. The method of claim 37, wherein less than a monolayer of the nanoscale particles are deposited within and/or on the fibrous support.

51. The method of claim 37, comprising heating the fibrous support to form from about 0.1 to 50 wt. % nanoscale particles deposited on the fibrous support.

52. A method of treating smoke produced by the cigarette of claim 15, comprising lighting the cigarette to form smoke and drawing the smoke through the cigarette such that the catalyst acts as a catalyst for the conversion of carbon monoxide to carbon dioxide and/or nitric oxide in the smoke to nitrogen.

53. A cigarette comprising:

cut filler, wherein the cut filler comprises tobacco; and a catalyst capable of acting as a catalyst for the conversion of carbon monoxide to carbon dioxide and/or nitric oxide to nitrogen, wherein the catalyst comprises a glass fiber containing fibrous support and nanoscale metal particles and/or nanoscale metal oxide particles supported on the fibrous support, wherein the nanoscale metal particles comprise B, C, Mg, Al, Si, Ti, V, Cr, Mn, Fe, Co, Ni, Zn, Ge, Y, Zr, Nb, Mo, Ru, Rh, Pd, Ag, Sn, Hf, Ta, W, Re, Os, Ir, Pt, Au, or combinations thereof, wherein the nanoscale metal oxide particles comprise oxides of B, C, Mg, Al, Si, Ti, V, Cr, Mn, Fe, Co, Ni, Zn, Ge, Y, Zr, Nb, Mo, Ru, Rh, Pd, Ag, Sn, Hf, Ta, W, Re, Os, Ir, Pt, Au, or combinations thereof, and wherein the catalyst is in a cigarette wrapper.

54. The cigarette of claim 53, wherein the catalyst comprises from 0.1 to 50 wt. % nanoscale particles supported on a fibrous support.

* * * * *